US006685551B2

(12) United States Patent
Adams et al.

(10) Patent No.: US 6,685,551 B2
(45) Date of Patent: Feb. 3, 2004

(54) ELECTRONICALLY-CONTROLLED ROTARY COIN CHANGE DISPENSER

(75) Inventors: Thomas P. Adams, Oconomowoc, WI (US); Robert L. Zwieg, Watertown, WI (US); Jon R. Stieber, Oconomowoc, WI (US); Richard P. Uecker, Juneau, WI (US); Daniel J. Folger, Oconomowoc, WI (US)

(73) Assignee: De La Rue Cash Systems Inc., Watertown, WI (US)

( * ) Notice: Subject to any disclaimer, the term of this patent is extended or adjusted under 35 U.S.C. 154(b) by 92 days.

(21) Appl. No.: 09/994,415

(22) Filed: Nov. 27, 2001

(65) Prior Publication Data

US 2002/0115404 A1 Aug. 22, 2002

Related U.S. Application Data

(63) Continuation-in-part of application No. 09/785,229, filed on Feb. 20, 2001.

(51) Int. Cl.[7] ..... G07D 1/02
(52) U.S. Cl. ..... 453/24
(58) Field of Search ..... 453/1, 2, 12, 16, 453/29, 30, 32, 33, 34, 37, 40, 49, 50, 53, 54, 57, 62

(56) References Cited

U.S. PATENT DOCUMENTS

| | | | | | |
|---|---|---|---|---|---|
| 3,191,609 | A | | 6/1965 | Gauselmann et al. | |
| 3,583,410 | A | * | 6/1971 | Bayha et al. | 453/20 |
| 3,590,833 | A | | 7/1971 | Walton | |
| 3,650,085 | A | | 3/1972 | Bav | |
| 3,918,607 | A | * | 11/1975 | Rowlette | 221/15 |
| 3,941,138 | A | | 3/1976 | Woodhouse | |
| 4,202,362 | A | * | 5/1980 | Kashio | 453/20 |
| 4,221,227 | A | | 9/1980 | Heiman | |
| 4,276,894 | A | | 7/1981 | Heywood | |
| 4,495,959 | A | | 1/1985 | Farber | |
| 4,593,709 | A | | 6/1986 | Duplessy | |
| 4,746,319 | A | * | 5/1988 | Zwieg et al. | 453/32 |
| 4,798,558 | A | * | 1/1989 | Bellis | 453/32 |
| 4,836,825 | A | * | 6/1989 | Smeets et al. | 453/49 |
| 4,943,257 | A | | 7/1990 | Nilsson et al. | |
| 5,066,262 | A | | 11/1991 | Abe | |
| 5,122,094 | A | | 6/1992 | Abe | |
| 5,435,778 | A | * | 7/1995 | Castle et al. | 453/32 |
| 5,492,212 | A | | 2/1996 | Fillod et al. | |
| 5,595,535 | A | * | 1/1997 | Wenskus | 453/40 |
| 5,944,601 | A | | 8/1999 | Hayashi et al. | |
| 5,997,395 | A | * | 12/1999 | Geib et al. | 453/10 |

FOREIGN PATENT DOCUMENTS

| | | | | |
|---|---|---|---|---|
| GB | 2038064 | * | 7/1980 | G07D/9/06 |

* cited by examiner

*Primary Examiner*—Donald P. Walsh
*Assistant Examiner*—Mark J. Beauchaine
(74) *Attorney, Agent, or Firm*—Quarles & Brady LLP

(57) ABSTRACT

A coin dispenser (20) has a base (25) for supporting an integrally formed coin magazine (23) with coin channels (24) rotating along a coin path (49). A coin ejector (80) is located at a single coin ejection location and proximate to said coin path (49) to eject coins from the bottom of the coin channels (24) into a change cup (28). Electronic sensors (45, 46) are provided for anticipating the approach of the coin channels to the coin ejector (80) and to a low coin sensing station (50). An electronic control (90) is responsive to position signals from the position monitors (45, 46) for coordinating operation of the coin ejector (80) and the low coin sensor (51). A coin exit sensor (48) is positioned in a coin exit channel (27) just before the change cup (28) to send a signal to the electronic control (90) to confirm the ejection of each coin.

30 Claims, 14 Drawing Sheets

ELECTRONICALLY-CONTROLLED ROTARY COIN CHANGE DISPENSER

CROSS-REFERENCE TO RELATED APPLICATIONS

This is a continuation-in-part of Adams et al., U.S. patent appl. Ser. No. 09/785,229, filed Feb. 20, 2001, and entitled "Coin Dispenser."

BACKGROUND OF THE INVENTION

The invention relates to coin dispensers, and in particular to coin dispensers of the type for dispensing change. Such coin change dispensers are found, for example, at cashier checkout locations and ticket booths and many other places.

Perhaps the best known type of coin change dispenser has a vertical configuration in which a plurality of upstanding coin holding tubes are aligned in a row. Examples of such coin change dispensers are shown, for example, in Walton, U.S. Pat. No. 3,590,833 and Duplessy, U.S. Pat. No. 4,593,709.

Such dispensers are assembled from a large number of small, machined, mechanical parts, especially the parts of the coin ejector mechanisms. A coin dispenser having nine coin tubes would typically provide nine coin ejector mechanisms and each of these would include many small parts.

Coin change dispensers having a more circular configuration have been disclosed in the patent literature, but are not known to have received widespread commercial acceptance. Gauselmann, U.S. Pat. No. 3,191,609 proposed a stationary housing in which a plurality of coin tubes are arranged in a circle or oval. To eject coins from each tube, a coin ejector mechanism moves in a circular or oval path.

Heywood, U.S. Pat. No. 4,276,895 mounts a plurality of vertical coin tubes, arranged in a circle, on a rotatable base. As the base rotates, the coin tubes become aligned with an individual coin ejecting mechanism. The coin ejecting mechanism has a toothed ring that drives two ejector pins that are disposed 180° apart. One of the ejector pins is lifted for ejection of a coin by a camming arrangement. This arrangement appears to be disadvantageous for dispensing coins from different coin tubes due to the apparent slow response time for ejection of each denomination.

Adams et al., U.S. Pat. Appl. No. No. 09/785,229, filed Feb. 16, 2001, disclosed the concept of a rotary coin change dispenser with a rotating coin magazine and a single ejector positioned at a single non-movable location around a circular coin path produced by rotation of the coin magazine.

There is a need for improvement in the construction of a rotary coin dispenser to provide a relatively small number of parts, and therefore, a lower manufacturing cost, and to provide modern electronic control for coin dispensing and low coin sensing operations.

SUMMARY OF THE INVENTION

The invention provides a novel coin magazine assembly and a number of control features for a rotary coin changer. The invention provides a look-ahead electronic sensor for sensing the approach of a coin channel from which a coin is to be ejected. The invention further provides a look-ahead electronic sensor for sensing the approach of a coin channel to be tested for a low coin condition. The invention further provides an electronic home position sensor for synchronizing operations of a rotating coin magazine. And, the invention provides an electronic exit sensor for sensing ejection of the coins into a dispensing cup to verify that coins have actually been ejected as desired.

The invention further provides position markers for monitoring the angular position of the rotating coin magazine relative to a coin ejector and a low coin detector.

A general object of the invention is to improve the control of coin dispensing by applying modern electronic processors and sensors.

Another object of the invention is to provide an integral coin magazine in which coins are easily loaded, securely held and easily dispensed.

Another object of the invention is provide a minimum number of molded parts in a coin magazine assembly, thereby reducing costs when the dispenser is manufactured in significant volume.

One advantage of the invention is that it is easily adaptable to different national coin sets and to different change capacities, such as $0.99 and $4.99. One coin dispenser could be used with different magazines, including magazines with coins from different countries. The control of the machine with different magazines is accomplished through programmable electronic control.

The coin dispenser of the invention can be used in many applications. For example, the coin dispenser can be used to dispense change at the checkout counter of a grocery store or a convenience store, or at the cashier of a restaurant. The coin dispenser can be provided as part of a system that provides change in exchange for paper currency, or it can be provided in tandem with a currency dispenser, for example, as part of an ATM. It also could be part of a point-of-sale terminal.

Other objects and advantages of the invention, besides those discussed above, will be apparent to those of ordinary skill in the art from the description of the preferred embodiments which follow. In the description, reference is made to the accompanying drawings, which form a part hereof, and which illustrate examples of the invention.

DETAILED DESCRIPTION OF PREFERRED EMBODIMENTS

Figure 1:
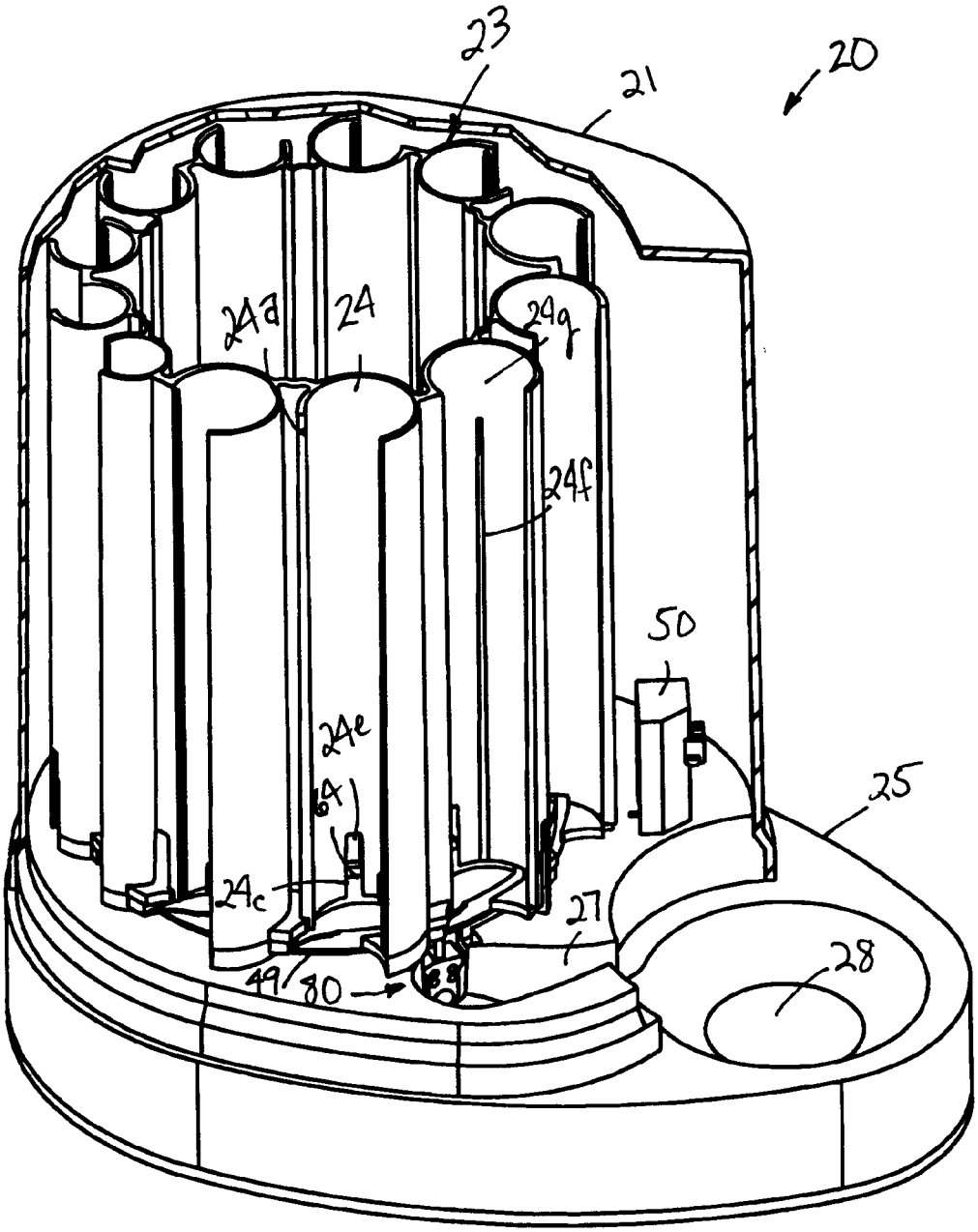
FIG. 1 is a perspective view of a coin dispenser according to one embodiment of the invention with a cover broken away.

A preferred embodiment of a coin change dispenser 10 according to the present invention is illustrated in FIGS. 1–13. As shown in FIG. 1, the coin dispenser 20 includes an outer, generally cylindrical cover 21 that covers a generally cylindrical coin magazine assembly 22 (FIG. 11). The cover 21 can be opaque or transparent or can include a transparent part. The cover 11 can be locked to the base 25 to prevent access to the interior of the coin dispenser 10 (FIG. 11).

The coin magazine assembly 22 includes a magazine 23 formed with a plurality of upstanding coin channels 24, in this example, numbering twelve. As seen in FIG. 1, the coin channels 24 are empty, to allow a view of the underlying structure, however, in use, these channels 24 would hold stacks of coins, each channel 24 being dedicated to a corresponding denomination. It may be also be advantageous to have more than one stack of coins for certain denominations, such as dimes for example, in making $.99 change for one U.S. dollar.

The coin magazine assembly 22 is mounted on a base 25 for rotation in a counterclockwise direction. As it rotates to move the coins along a circular coin path, a single coin ejector 80 is repeatedly operated to eject coins from the bottom of the coin channels 24 into dispensing channel 27 and then into a cup 28. Both the dispensing channel 27 and the cup are formed in the base 25, which is an integrally molded component. As an alternative, the cup 28 can be provided as a separate piece and mounted to the base 25 or other types of coin chutes or ramps can be used to transfer coins to a receptacle or device.

Figure 2:
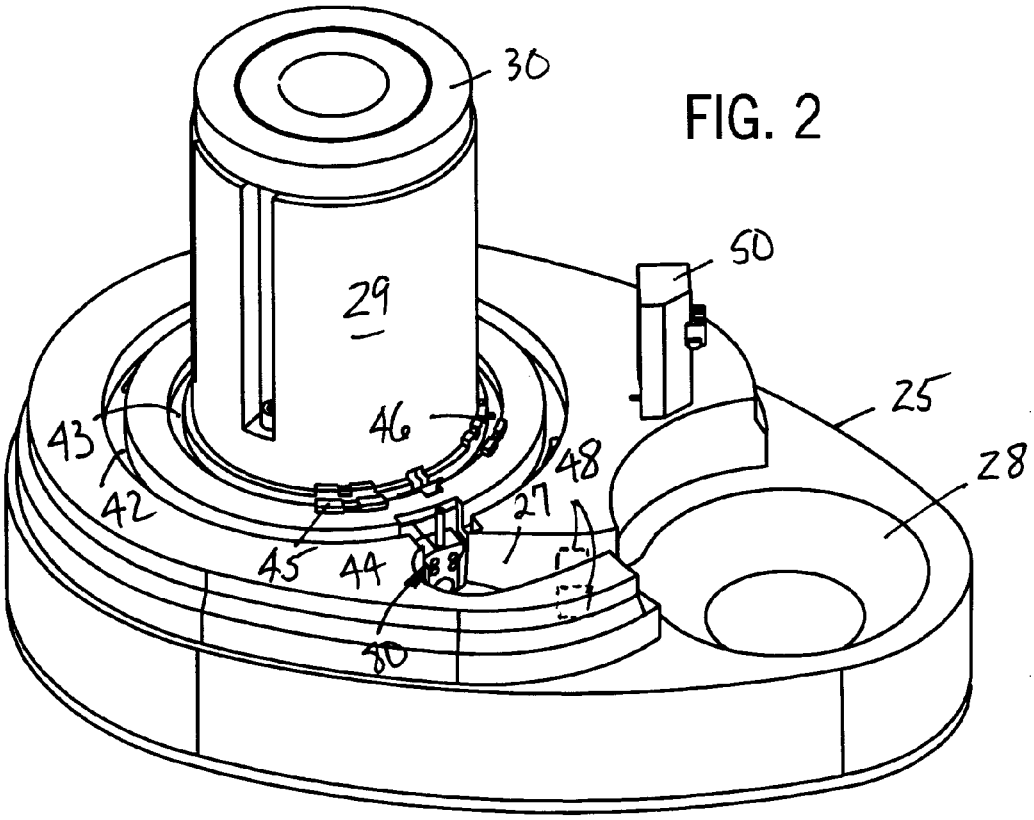
FIG. 2 is a perspective view of a base assembly of the coin dispenser of FIG. 1 with the coin magazine removed.
Figure 7:
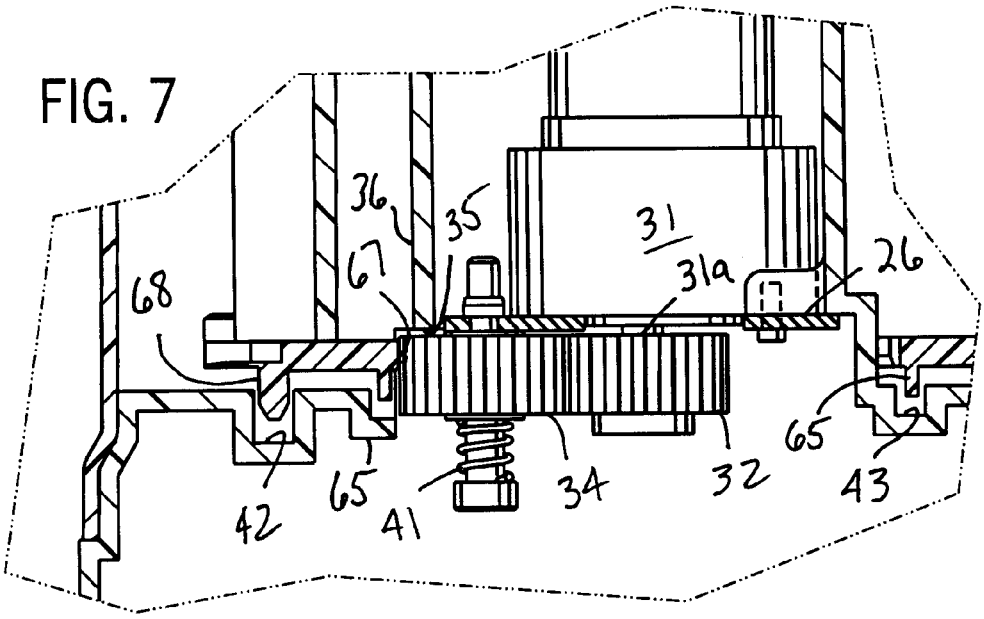
FIG. 7 is a detail sectional view of the apparatus of FIG. 1 showing a drive mechanism for the coin dispenser.

FIG. 2 shows the base 25 with the coin magazine assembly 22 removed. The base 25 includes a cylindrical post 29, which supports an annular bearing 30 on which the magazine assembly 22 is supported for rotation, as seen in more detail in FIG. 3. As further seen in FIG. 7, inside the post 29, a motor 31 is mounted on a supporting plate 26. A first gear 32 is mounted on the motor output shaft 33 for driving a second gear 34. The second gear 34 projects through an opening 35 in a sidewall 36 of the post 29 to engage and drive a ring gear 67 seen in FIG. 11. The second gear 34 is movable against a bias force provided by a spring 41 seen in FIG. 7, so that the gears 34 can mesh with the ring gear 67 during installation of the magazine assembly 22. The motor 31 is also coupled to drive gear 32 through a single-direction bearing (not seen in FIG. 7), which allows manual rotation of the magazine assembly 22 during installation and loading of the coins into the magazine 23.

Figure 7A:
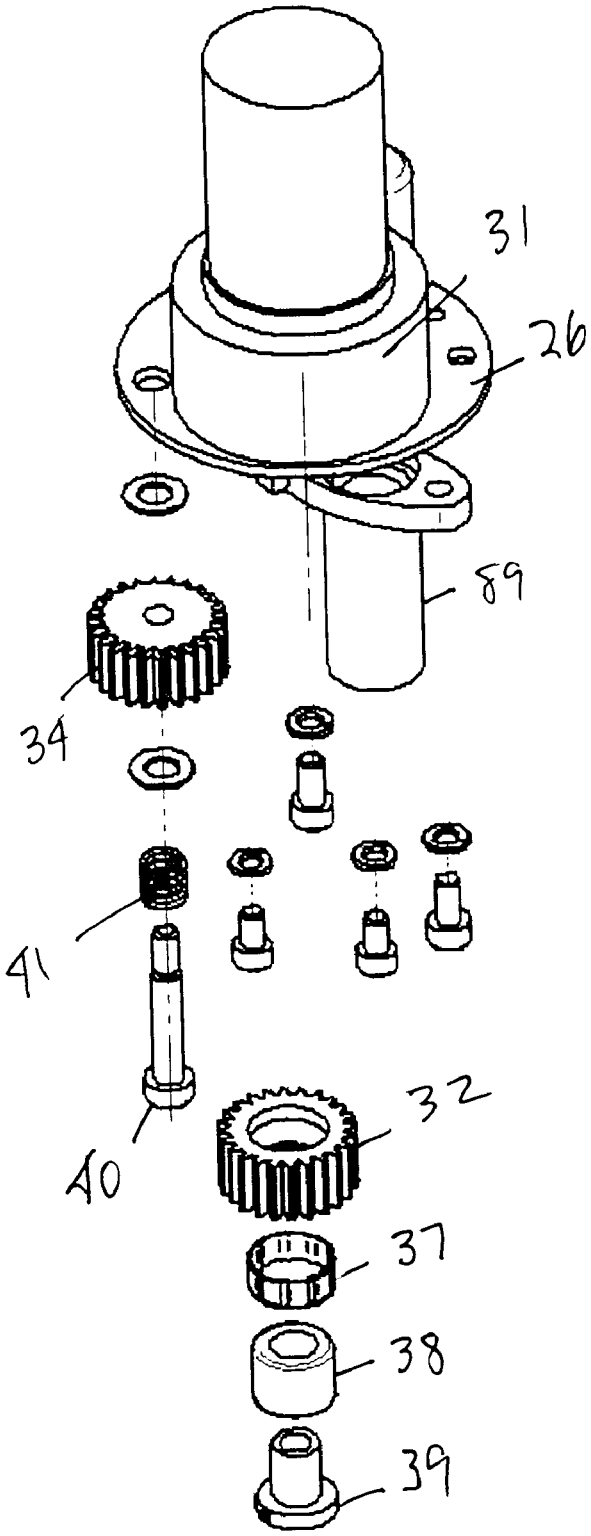
FIG. 7*a* is an exploded view of the drive mechanism of FIG. 7.
Figure 8A:
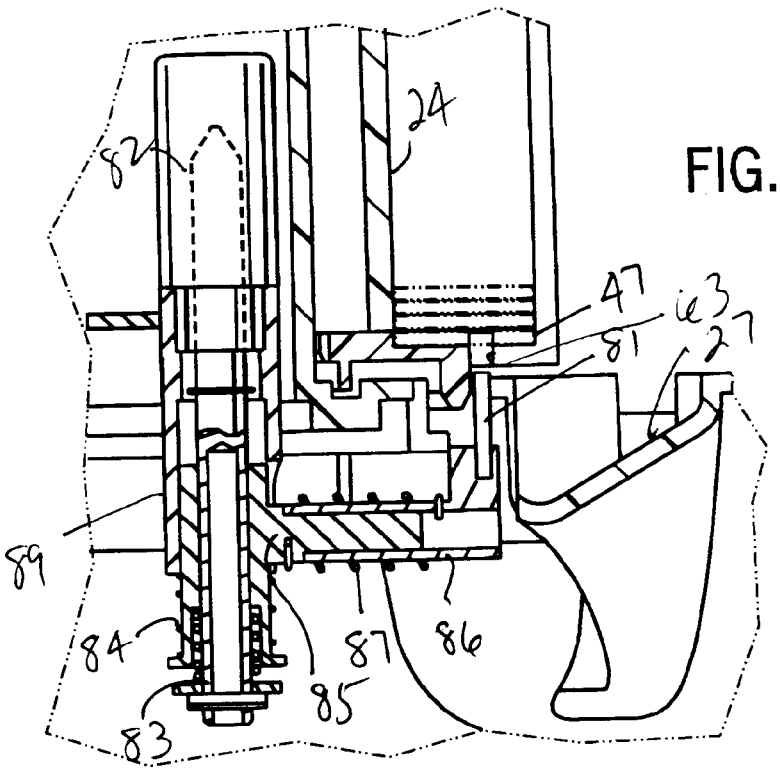
FIGS. 8*a* and 8*b* are detail sectional views of an ejector mechanism that is part of the embodiment of FIG. 1.
Figure 8B:
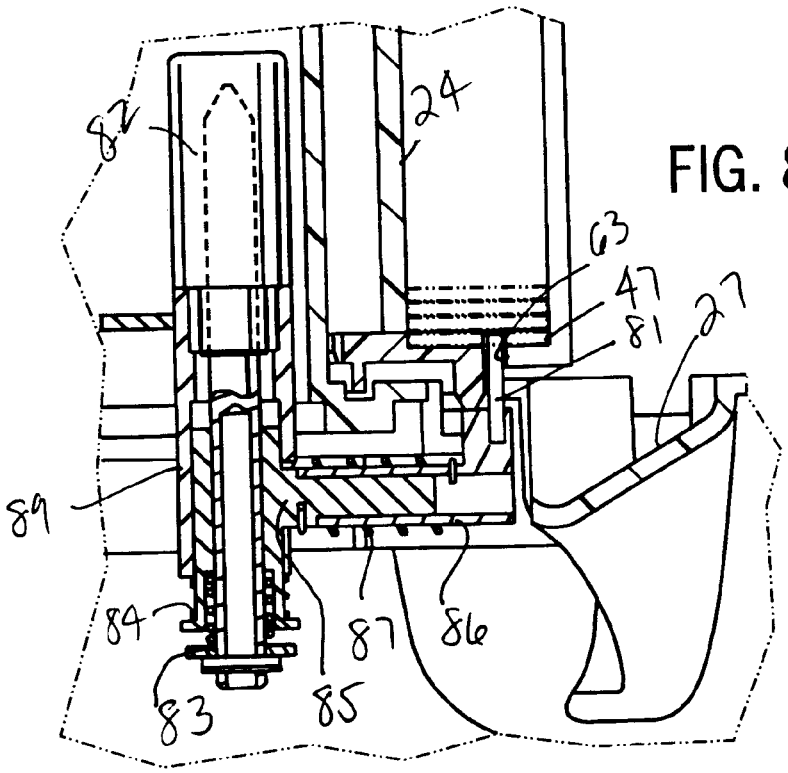

Referring to FIG. 7*a*, the drive mechanism assembly is disassembled. The motor 31 is mounted on the mounting plate 26, and an ejector housing 89 is mounted to an underneath side of the mounting plate 26. Drive gear 32, tolerance slip ring 37, roller clutch 38 and retainer 39 (FIG. 7*a*) are mounted to a depending end portion of the motor output shaft 31*a* (seen in FIG. 7). The tolerance slip ring 37 is a ring-shaped member with corrugations or ripples, and it fits over the roller clutch 38 and inside a cavity in the drive gear 32. A retainer 39 is inserted into a center cavity in the roller clutch 38, and a set screw (not shown) is inserted in a flange of the retainer 39 and screwed down against the motor output shaft to hold the retainer 39 on the motor output shaft 31*a*, which mounts the other parts 32, 37 and 38 on the motor output shaft 31*a*.

In operation, the roller clutch 38 allows rotation in only one direction, which is the counterclockwise direction of rotation for the magazine assembly 22. This allows the coin magazine to be rotated during loading operations. The tolerance slip ring 37 allows slippage of the gear 32 in relation to the motor output shaft 31*a* when rotation of the gear is opposed by a strong counter-torque, which may occur in coin jam condition. This feature supplements the yielding of the ejection pin 81 in a coin jam condition.

Figure 4:
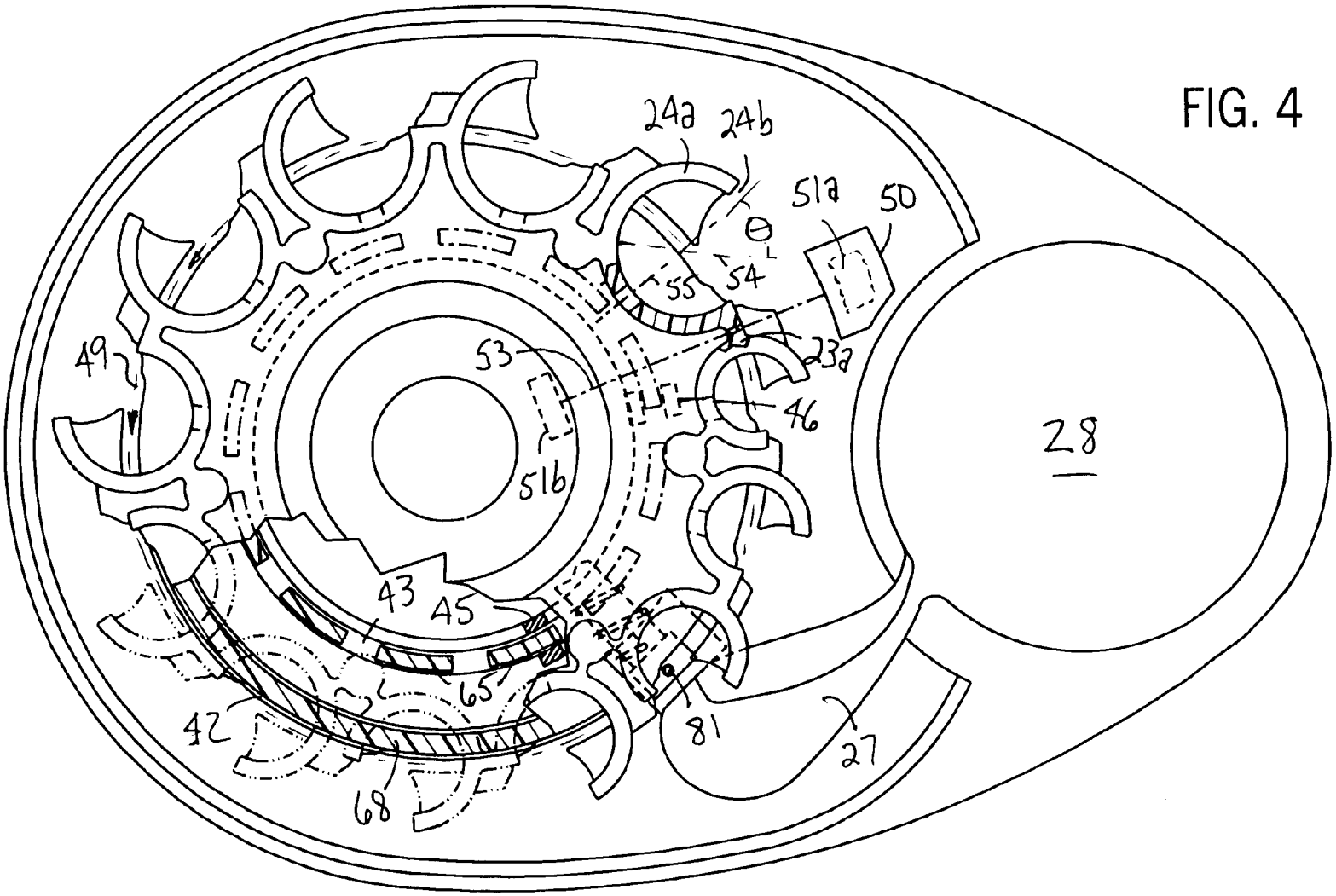
FIG. 4 is a top plan view of the base assembly of FIG. 2 with parts in section.

Referring back to FIG. 2, other details of the base 25 are shown. Two circular grooves 42, 43 are formed in a pedestal portion 44 of the base 25 and encircle the post 29. Two position sensors 45, 46 for sensing the angular or rotational position of the magazine 23 are disposed in the inside groove 43. Each position sensor 45, 46 has a U-shaped housing with an optical emitter in one leg and an optical detector in the other leg. These position sensors 45, 46 will detect the passage of marker tabs 65 (FIG. 4) located on the bottom of the magazine assembly 22 (FIG. 11). The marker tabs 65 ride in the inner groove 43. A circular ridge 68 located on the bottom of the magazine assembly 22 (FIG. 11) rides in the outer groove 42 (FIG. 4). Also seen in phantom in FIG. 2 is a coin exit sensor 48 positioned in the dispensing channel 27 just before the entrance to the change cup 28. This sensor 48 sends a signal upon confirming the ejection of a coin by the coin ejector 80. Also seen is a home position housing 50 in which a signal emitter 51*a* of a home position/low coin sensor 51 is positioned as seen in FIG. 4. As further seen in FIG. 4, the detector 51*b* of this sensor 51 is located in the hollow central portion of the post 29 and a window is provided in the magazine cylinder 23 a window is provided in the post 29 to allow a signal to pass between the signal emitter 51*a* and the signal detector 51*b* along a line-of-sight 53. As used herein, the term "window" can be an opening or a signal-transmissive portion that allows a home or low coin signal to pass through.

As seen best in FIG. 11, the coin magazine assembly 22 includes a ring-shaped coin magazine 23 and a ring-shaped magazine base member 60, which are integrally molded components made of a high durability plastic material or metal. The coin magazine 23 is generally cylindrical in shape and forms a plurality of longitudinally extending coin-holding channels 24 around its periphery, with coin exit openings 24*b* through its outer surface. As seen best in FIG. 4, each channel 24 has a sidewall 24*a* seen in a C-shape in cross section with an opening 24*b* in the channel sidewall 24*a* facing to the outside of the magazine 23. The diameter of each channel 24 varies according to the denomination of coins it will hold. Each channel 24 is formed along a transverse axis 54 of symmetry that is oriented at an angle θ with respect to a radius 55 from the center of the magazine 23, such that the channel openings 24*b* face in a rearward-looking direction in relation to the counterclockwise direction of rotation of the magazine 23. In a preferred embodiment, the angle θ is thirty-two degrees. This angle reduces the likelihood that coins will be ejected inadvertently due to centrifugal force. It also reduces the force of ejection in comparison with an ejection in the radial direction.

The coin magazine 23 is formed with channels having a taper of not greater than 0.2 degrees, having a plurality of circumferentially spaced, zero taper ribs 24*f* (FIG. 1) running up inner sidewall surfaces 24*a* of the channels 24 for securely holding the coins, with the ribs 24*f* terminating a spaced distance from a top opening of the channels 24 to provide a slightly angled funnel 24*g* (FIGS. 1 and 11) to allow for easier loading of coins. Normally, in molding a part such as the magazine 23, the walls 24*a* of the channels 24 would be provided with some taper for molding purposes. That has been minimized in this construction.

Figure 6A:
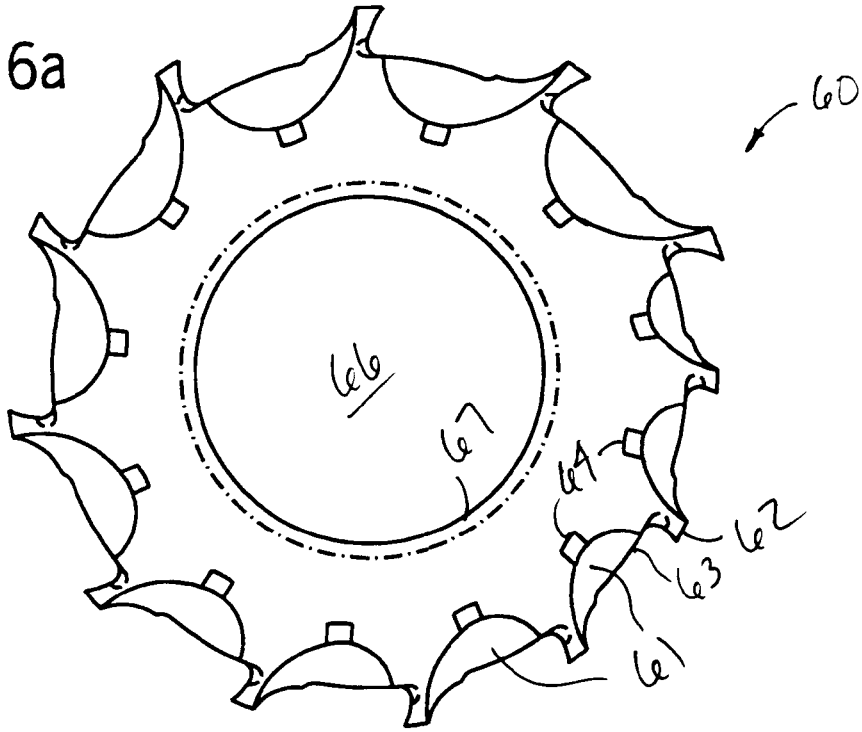
FIGS. 6*a* and 6*b* are top and bottom plan views of a magazine base included in the assembly of FIGS. 5*a*–5*c;*
Figure 6B:
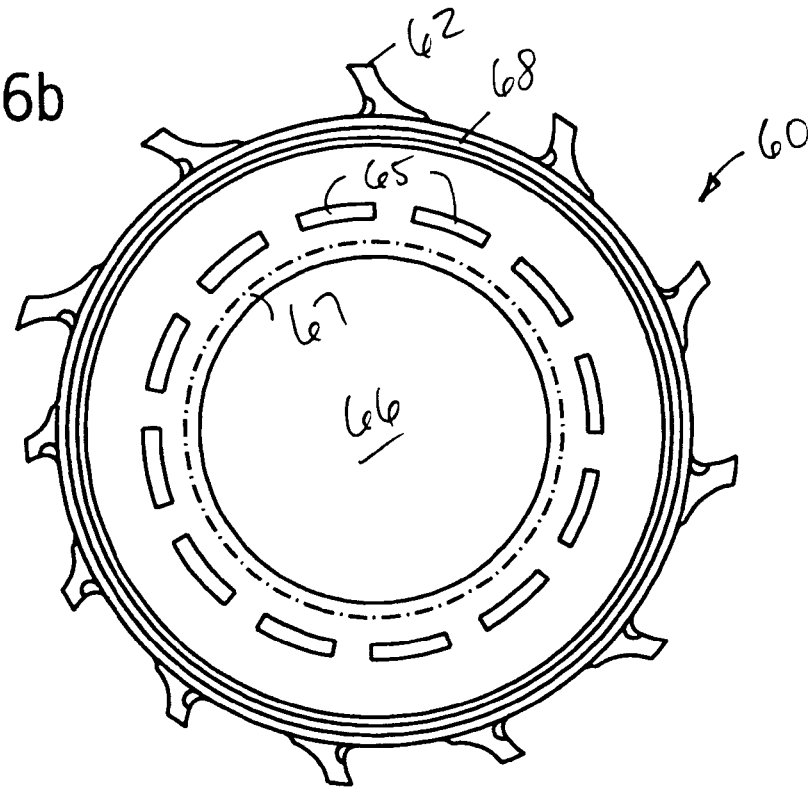

The magazine base member 60 is seen in detail in FIGS. 6*a* and 6*b*. The magazine base member 60 has a central opening 66 and a ring gear 67 is formed around this opening 66. On the bottom of the base member 60 seen in FIG. 6*b* are integrally molded, opaque marker tabs 65 corresponding to the respective channels 24. These tabs 65 are of slightly differing length according to the diameter of their corresponding channel 24. The tabs 65 are displaced by an angle in advance of their corresponding channels 24 so as to be sensed by the position sensors 45, 46 in advance of the channel 24 reaching either the coin ejector 80 or the home/low coin sensing station 50 (FIGS. 2, 4). The position sensor 45 that cooperates with coin ejector 80 is positioned eighteen degrees in advance of the ejector 80 (FIGS. 2, 4). The position sensor 46 that cooperates with the low coin sensor is positioned ten degrees in advance of the home station 50, which houses part of the low coin sensor 51*a*, 51*b*. This means that the marker tab 65 for the first channel is angularly displaced from the first channel approximately ten degrees so as not to encounter the sensors 45, 46 before the first channel is opposite either the beginning of the ejector 80 or opposite the low coin sensor 51*a* 51*b*.

The base member 60 also includes square posts 64 (FIG. 6*a*) that project upward from a top of the member 60 to be received in the slots 24*c* in the channel sidewalls 24*a* to be described. As seen in FIGS. 1 and 11, when the magazine base 60 is assembled to the magazine 23, the square posts 64 fit into the slots 24*c* in the magazine 23 to locate the magazine base member 60 at the proper rotational position in relation to the magazine 23. Bolts 70 (FIG. 11) are inserted through six holes 69 in the magazine base 60 into bosses 23*b* formed in the magazine 23 and seen from the top in FIG. 4.

The magazine base member 60 forms partial floors 61 for each channel 24 which are separated by barrier projections 62. When assembled with the magazine 23 (FIG. 5*a*), this member 60 forms an arcuate slot 63 for each channel 24 for receiving a pin 81 (FIG. 12*a*) of a coin ejector 80. The slots 63 are formed along a circular coin path 49 (FIG. 4) followed by the stacks of coins as the magazine 23 is rotated.

Figure 5A:
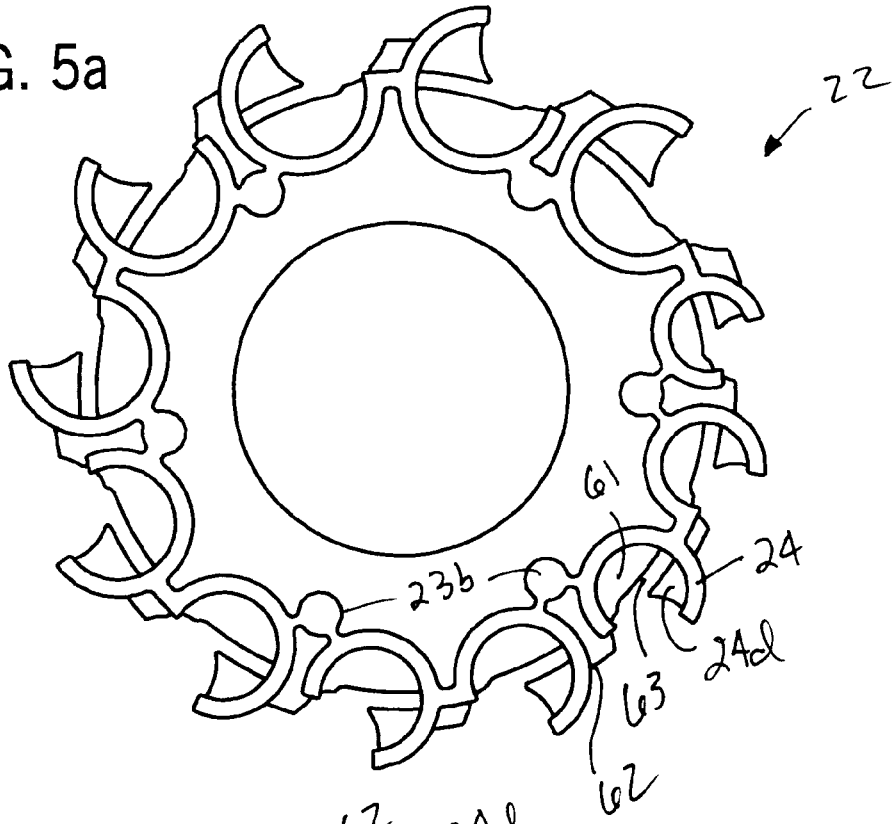
FIGS. 5*a*–5*c* are top, bottom and detail views of the coin magazine assembly seen in FIG. 1.
Figure 5B:
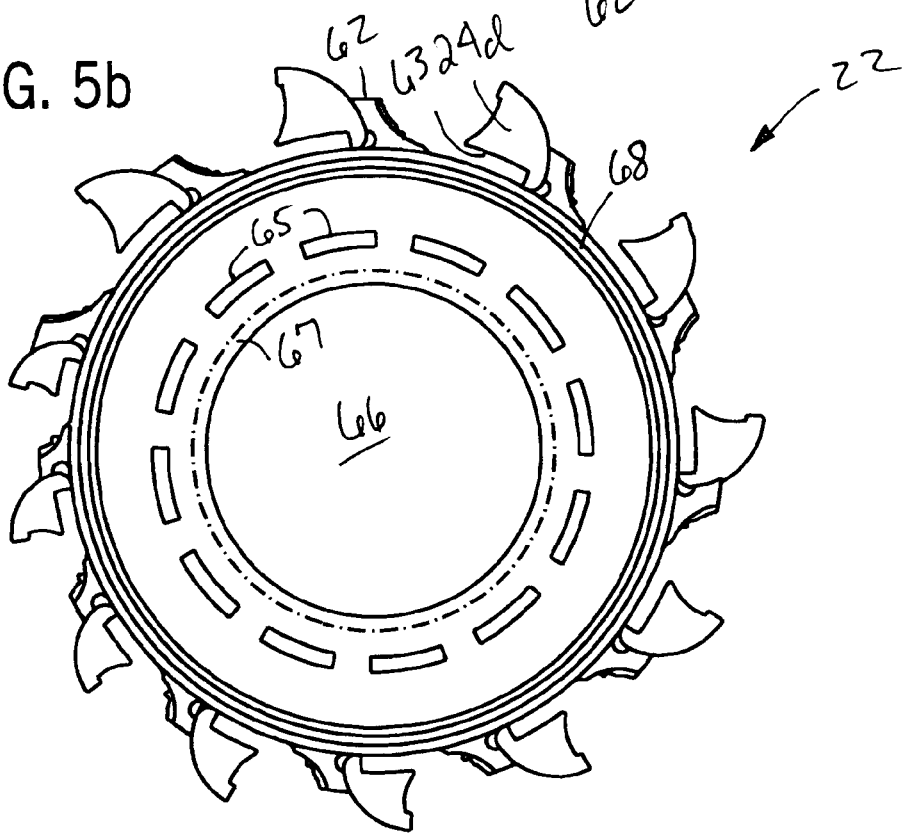
Figure 12A:
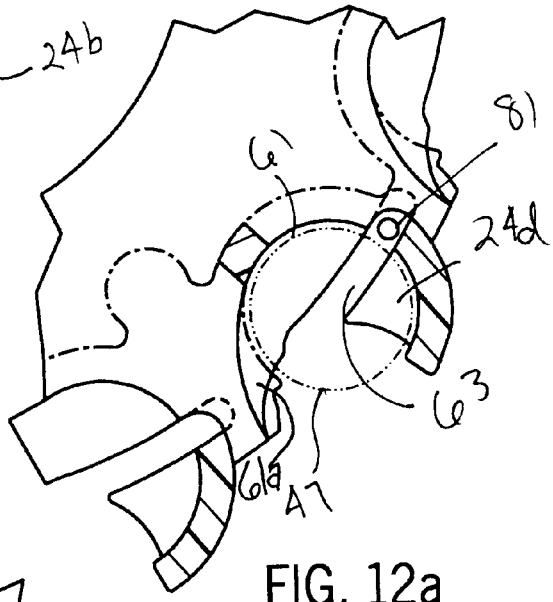
FIGS. 12*a* and 12*b* are further detail views of the magazine assembly of FIGS. 5*a* and 5*b;*
Figure 12B:
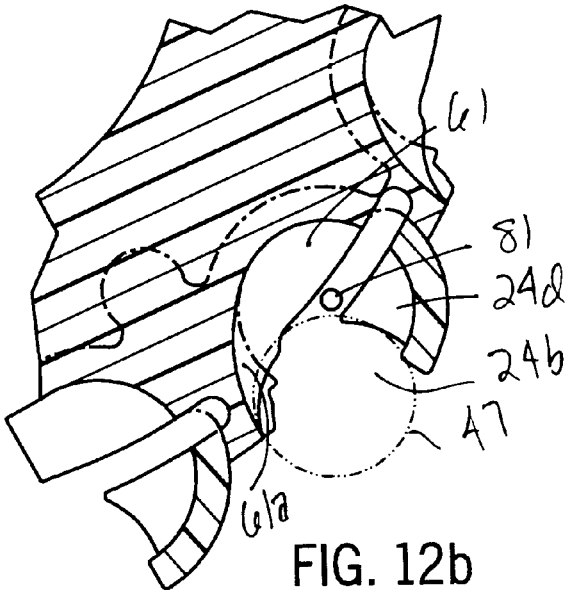

As seen in FIGS. 5*a*, 5*b* and 11, the magazine also forms partial floors 24*d* in each channel 24 for supporting a lower end of a stack of coins. As seen in FIGS. 12*a* and 12*b*, these partial floors 24*d* further define the slots 63 in each channel for receiving the pin 81 of the coin ejector 80. The partial floors 24*d*, 61 must be large enough to prevent the coins from falling through the slots 63 even when a single coin is located in channel 24. The relationship between the size of the floor 24*d*, 61 and variously sized coins is illustrated in FIGS. 5*c* and 12*a*.

As seen in FIGS. 1 and 11, the magazine 23 also forms the upright slots 24*c* that are located a short distance above the floors 24*d* in the bottom of each channel 24. These slots 24*c* receive the posts 64 of the base member 60, but have an open portion above that which forms a window 24*e* (FIG. 1) for marking a low level of coins. A signal is transmitted through such a window 24*e* when the channel 24 is opposite the home station emitter 51*a*. If the signal (logic "1") is detected by the home station detector 51*b* when a channel 24 has its window 24*e* aligned between the home station emitter 51*a* and the home station detector 51*b*, it means that the coin level is low, because it means the signal path is unobstructed by coins in the channel 24. The use of one sensor 51*a*, 51*b* for both low coin and home position functions allows verification of the circuitry during each dispense cycle.

Figure 3:
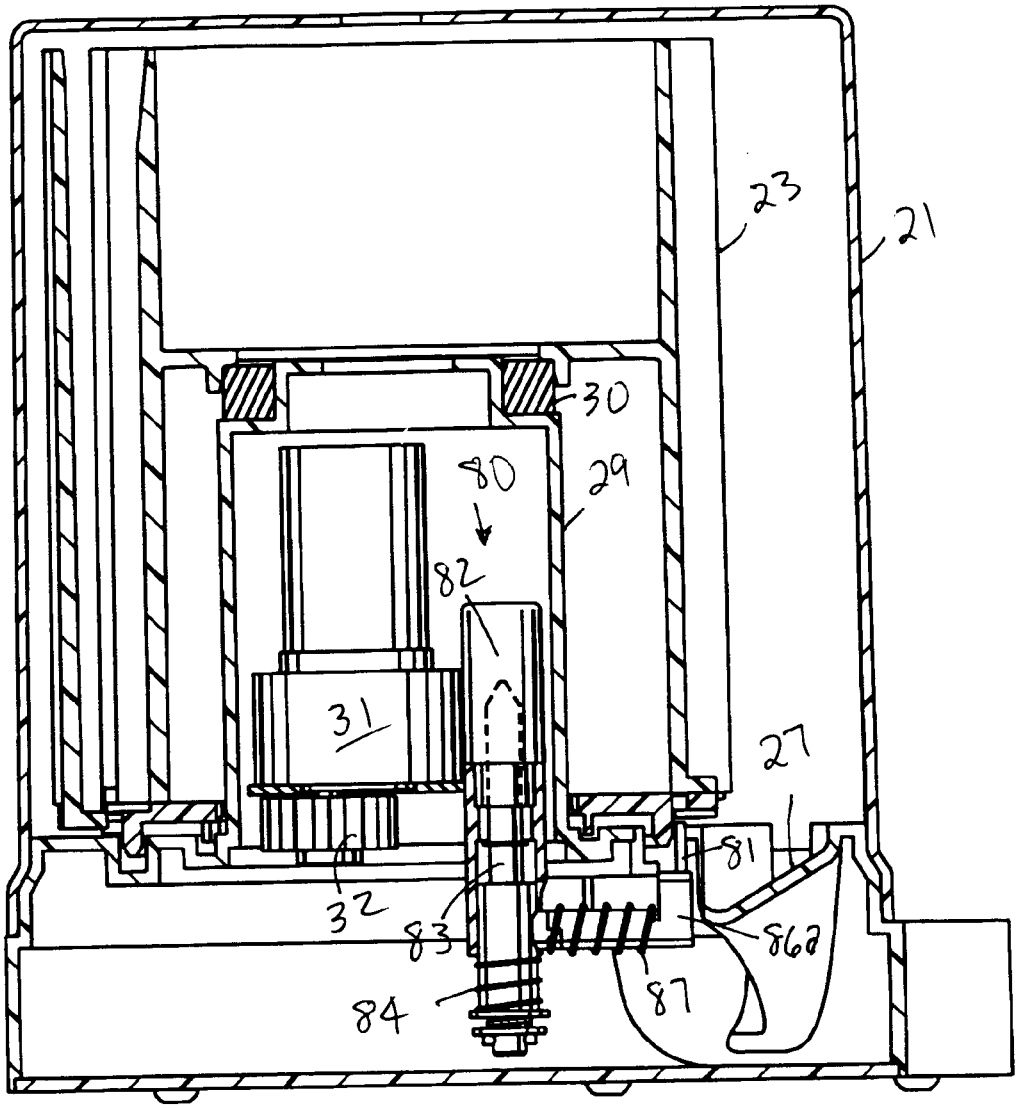
FIG. 3 is a vertical section view of the coin dispenser of FIG. 1.

Referring to FIG. 3, a coin ejector 80 is supported on a plate 26 with the motor 31 inside the post portion 29 of the machine base 25. The coin ejector 80 includes a pull-type solenoid 82 that is attached to the plate 26, which is mounted in the base 25. When the solenoid 82 is electrically energized, it moves a plunger 83 upwards and compresses a return spring 84. The ejector 80 has an arm 85 mounted on the plunger 83 for movement with the plunger 83. A sleeve 86 is mounted on the arm 85 for rotation and has a projection 86*a* at a free end that mounts the ejector pin 81. The sleeve 86 is biased to its position by a torsion spring 87, so that if the pin 81 encounters a force of the type encountered when a coin is jammed, the sleeve 86 will rotate against the torsion spring 87 and allow the pin 81 to yield, thereby preventing damage to the ejector 80.

Figure 5C:
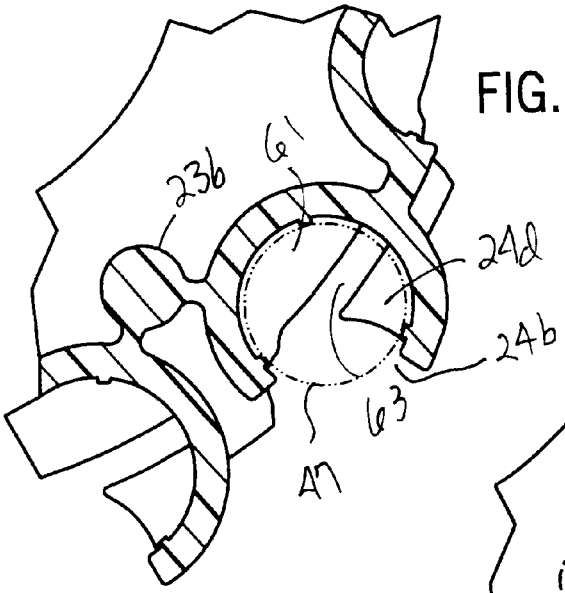

The manner in which a coin is ejected from a channel 24 is illustrated diagrammatically in FIGS. 5*c*, 12*a* and 12*b*. As seen in FIG. 5*c*, a coin 47 at the bottom of coin channel 24 rests on the partial floor 24*d*, which is part of the magazine 23 and the floor 61 on the base member 60 on the inner side of the slot 63. When the ejector 80 is to eject a coin 47, it is inserted upward into the ejection slot 63 for that channel 24 as seen in FIG. 12*a*. As the magazine 23 is rotated, the pin 81 moves down the slot 63 pushing the coin off of the partial floors 24*d*, 61 and onto land 61 *a* formed on the base member 60 and finally out of the channel 24 through the opening 24*b*.

The bottom of the magazine 23 is spaced above land 61 *a* (FIG. 12*a*) by the thickness of one coin to form an exit slot from the bottom of coin channel 24. In the way, a thickness gage is provided. This allows only the lowermost coin in each channel 24 to be pushed out of the coin channel 24 and over land 61 *a* by the ejector pin 81 as seen in FIG. 12*b*.

The ejector 80 is a single mechanism located at a single location along the circular coin path 49. As seen from another view in FIGS. 8*a* and 8*b*, when the channel 24 containing a coin 47 that is to be dispensed reaches the position of the ejector 80, the actuation of the solenoid 82 will cause the pin 81 to move vertically upward through slot 63 (FIG. 8*b*) such that it will contact the edge surface of the lowermost coin 47 in that receptacle 24. The pin 81 engages the coin at a point approximately midway between the opposite portions of the sidewall 24*c* of the channel 24. This will push the coin out of the channel 24, through the dispensing channel 27 and into the change cup 28. The solenoid 82 is then de-energized and the force provided by the return spring 84 will move the pin 81 vertically downward to its starting position seen in FIG. 8*a*. If the pin 81 does not fully retract, the pin 81 will be urged downward by a bottom surface of the magazine 23. The pin 81 will not engage the lowermost coin in a next channel unless the solenoid 82 is energized again. The coin ejection pin 81 moves linearly in a direction substantially parallel to the (vertical) rotation axis of the magazine 23 between an extended position and a retracted position.

The depth of each channel 24 or the height of each floor 24*d* is determined based upon the thickness of the type of coin to be dispensed from the channel 24. The depth can selected so that the upper surface of the lowermost coin in each channel 24 is located in a common plane. This approach may be modified however, for coin sets including very thick coins by providing that the coin ejection pin reaches upward a predetermined distance sufficient to eject the lowermost coin in each receptacle, without necessarily reaching the top of the thickest coin. In addition, by selecting an appropriate depth of a channel 24 and thickness of the exit slot from channel 24, the pin 81 can be made to contact the two lowest coins in a receptacle so that two coins can be ejected simultaneously from one channel 24.

Figure 12C:
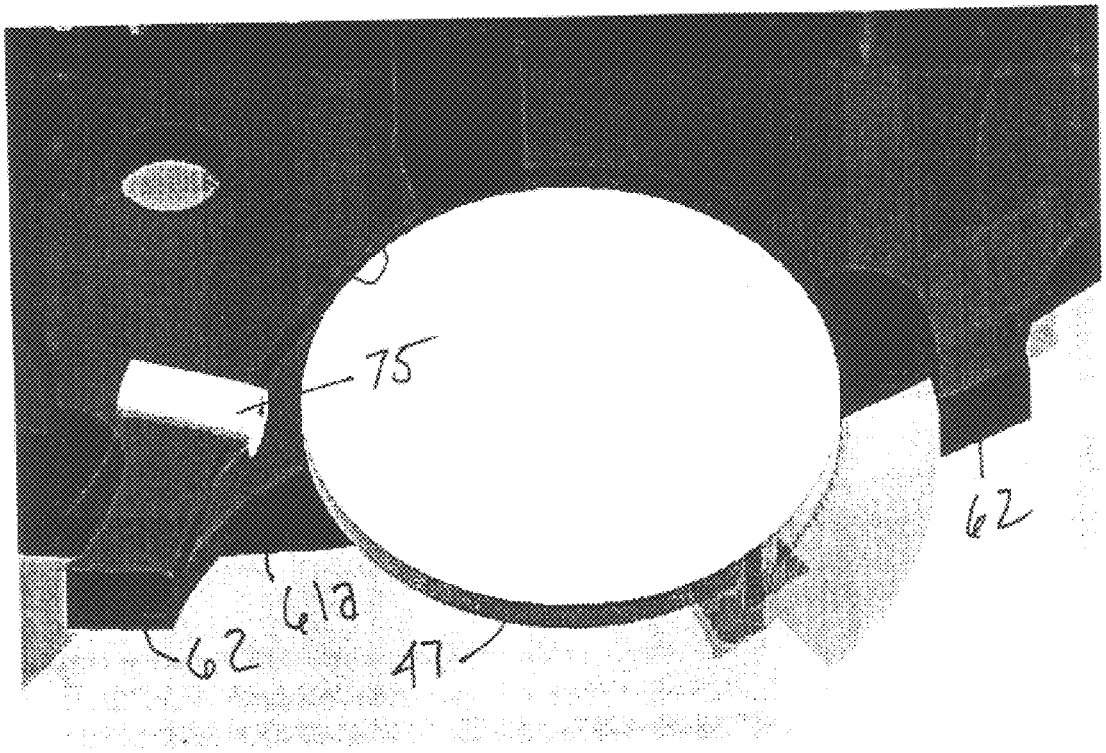
FIGS. 12*c* and 12*d* are detail perspective and section views of a detent mechanism located near the bottom of the coin magazine.
Figure 12D:
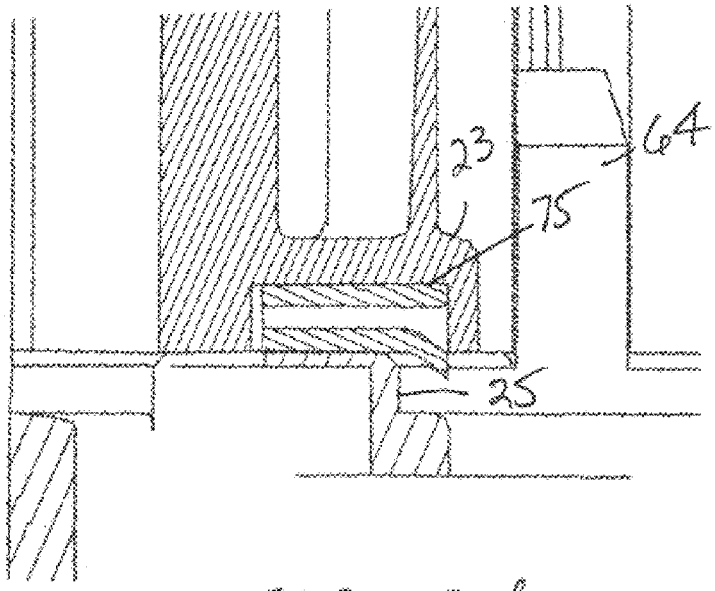

Referring to FIGS. 12*c* and 12*d*, a first variation of a coin detent 75 is shown. In FIG. 12*c*, coins 47 rests on the floor surfaces 61 in the bottom of each channel 24. A short length of urethane tube 75 is positioned in a niche in the bottom of the coin magazine 23 and projects into the coin channel above land 61 *a* leading from the coin channel 24. This forms a detent 75 in the coin exit slot for retaining the coin 47 and preventing it from exiting the coin channel 24 prior to ejection by the coin ejector 80.

In FIG. 11, a second embodiment of coin detents 71 is shown. These are provided in the bottom of the coin channels 24 to hold the coins in place, for example, when a loaded magazine is transported from one location to another.

The detents 71 are provided by L-shaped spring members. As seen in FIG. 11, the magazine 23 forms slots 24*h* on outer surfaces of the channels 24. The L-shaped detents 71 have an upright leg 71*a* that fits in a respective slot 24*h*, and each detent 71 also has a foot 71*b* that projects from a niche in the bottom of the coin magazine 23 into the coin exit slot from each coin channel 24, to assist in holding the stack of coins in each coin channel 24.

Figure 9:
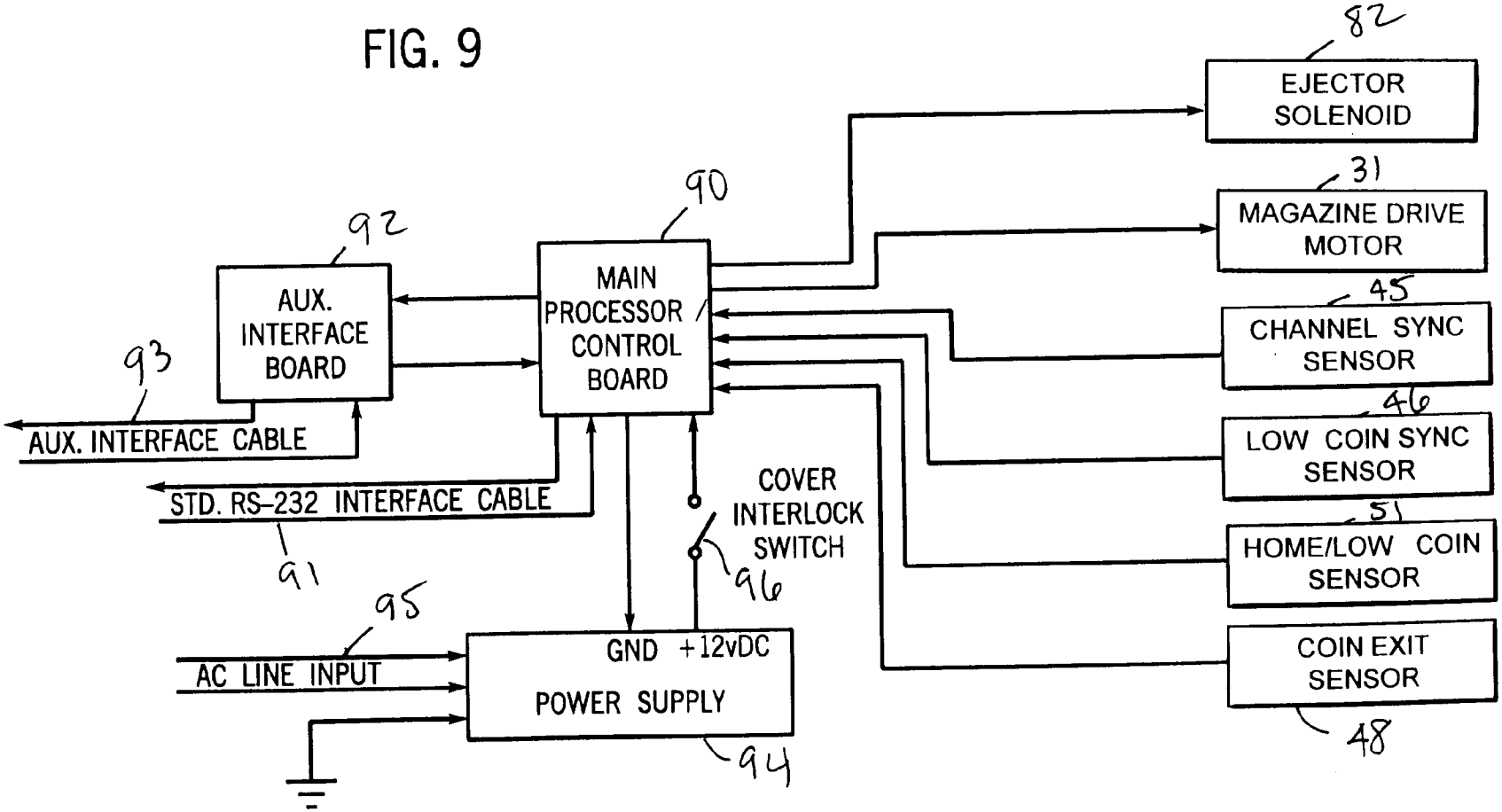
FIG. 9 is a block diagram of the electronic control circuit in the embodiment of FIGS. 1 and 2.

FIG. 9 shows the electronic controls for the dispenser 10. A main processor and control circuit board 90 (FIG. 9) is mounted in the base 25 of the machine 10 seen in FIGS. 1 and 2 and is connected to an RS-232 communication cable 91. Also mounted in the base 25 is an auxiliary interface circuit board 92, which is connected to an auxiliary interface cable 93. The auxiliary interface circuit board 92 provides alternative and enhanced capabilities to the electronic system to increase the machine versatility. It is a plug-in "daughter board" to the main processor and control circuit board 90. It can incorporate a flash memory for firmware program changes.

A power supply 94 (FIG. 9) is provided in a package similar to a battery-charging adapter for a notebook computer. The power supply 94 receives 120-volt AC power through a power cord 95 supplies 12-volt DC power to the main processor board through a cover interlock switch 96. When the cover 21 is open, the interlock switch 96 is open to disconnect power to the coin dispenser 10.

The main processor board 90 (FIG. 9) connects to the ejector solenoid 82, to the motor 31, to a "channel sync" position sensor 45 for synchronizing the position of a selected channel to the coin ejector 80, a "low coin sync" position sensor 46 for synchronizing the position of a selected channel to the home position/low coin sensor 51, which is also connected to the main processor board 90, and to the coin exit sensor 48.

Whenever AC input power is applied to the 12-volt DC power supply 94 or whenever the cover 21 is closed to lock the cover interlock switch 96, twelve DC volts are supplied to the main processor board 90. As a result the main processor executes an initialization routine to rotate the magazine 23 to the home position, stopping after a predetermined delay following detection of the home position and loading memory locations on the main processor board 90 with values representing magazine coin channels 24 with full stacks of coins. The delay is determined so as to ensure that the magazine 23 stops in a position that will allow it to be accelerated to the operational speed just prior to reaching the "home" position during an actual dispense cycle. This position is defined as the "pre-accelerate" position.

Figure 10:
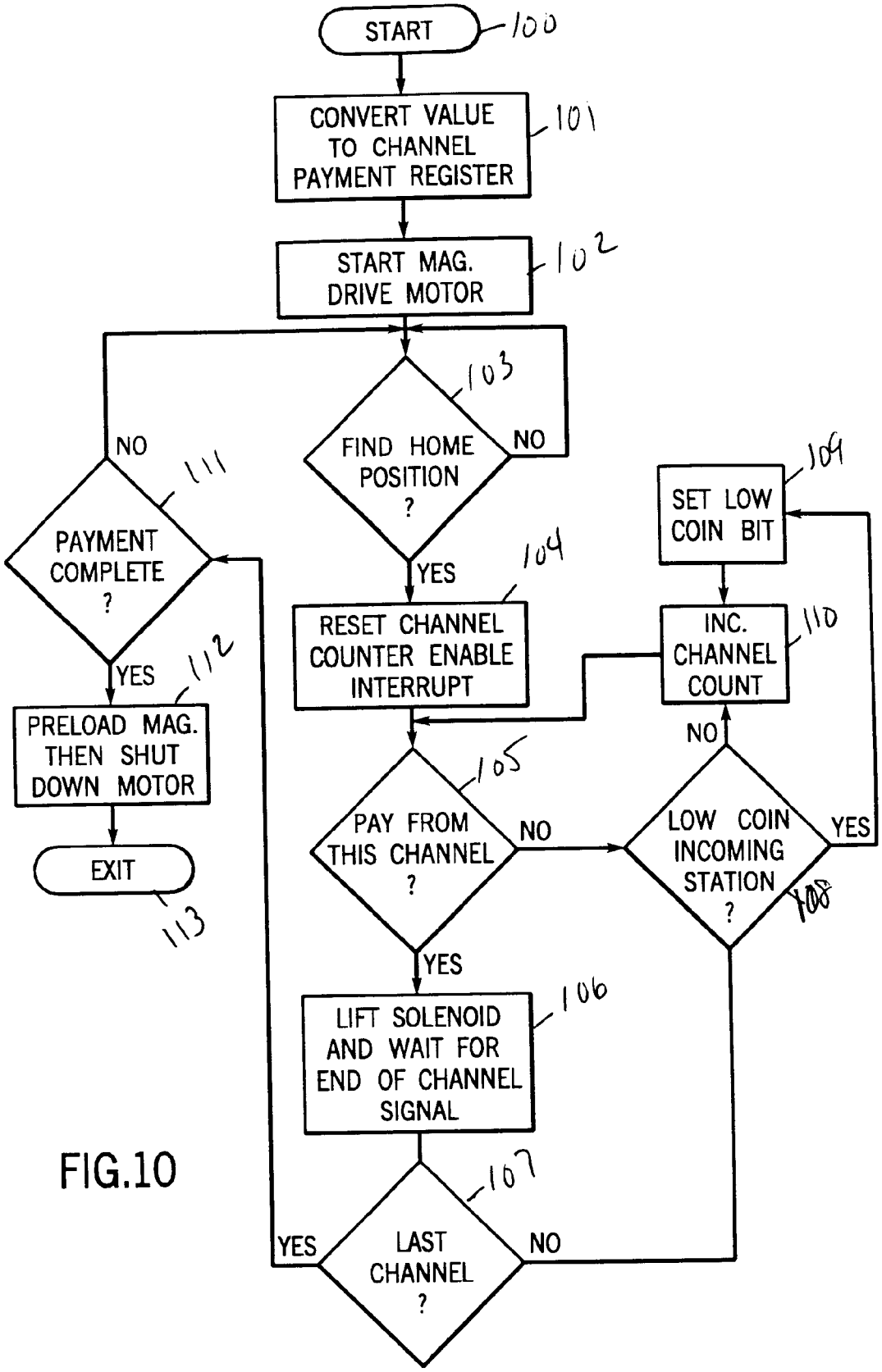
FIG. 10 is a flow chart of the operation of coin change dispenser of FIGS. 1 and 2.
Figure 11:
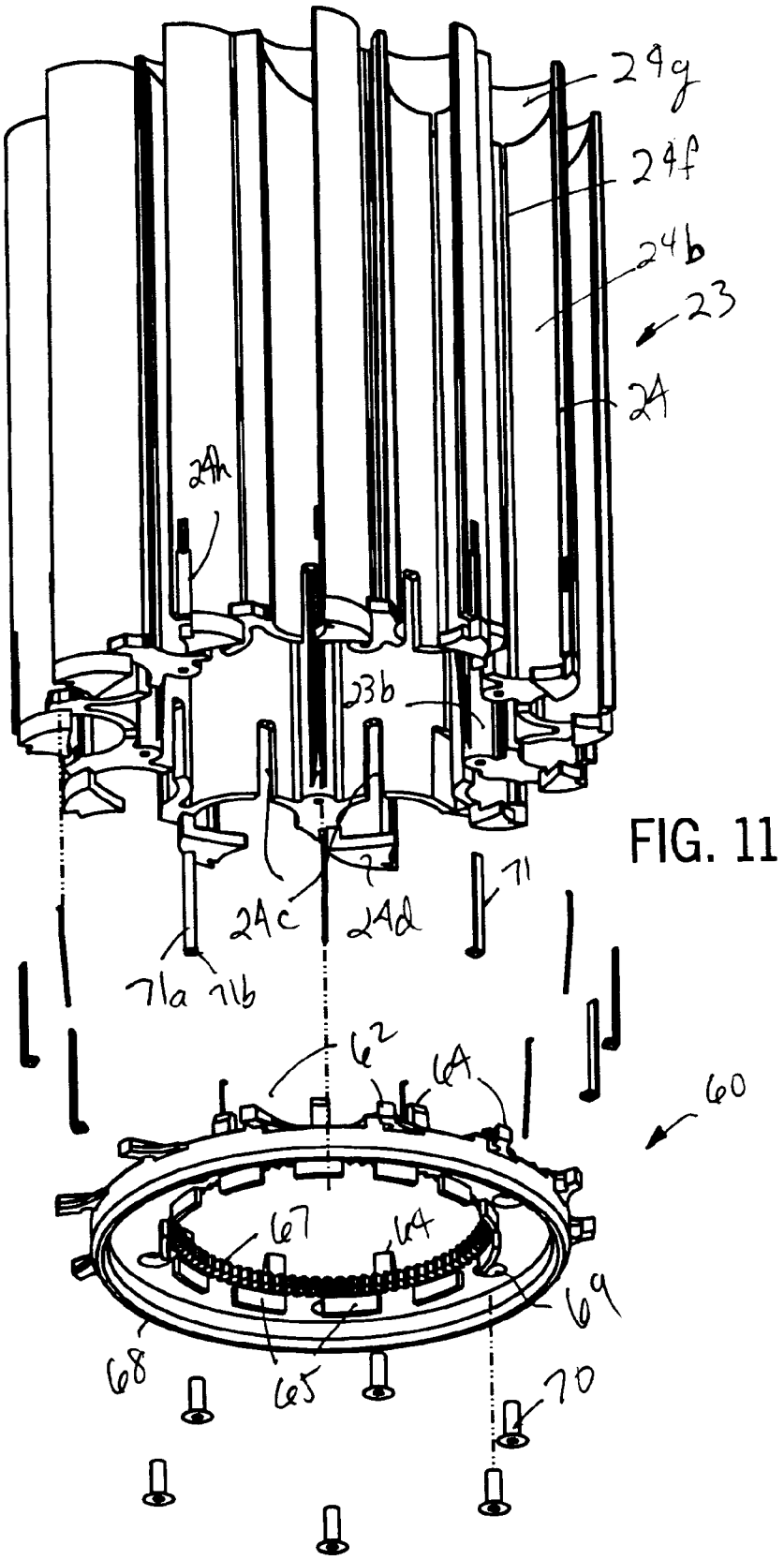
FIG. 11 is an exploded view of the magazine assembly of FIGS. 5*a* and 5*b;*

As seen in FIG. 10, which is a flow chart of the operation of the main processor on the main processor board 90, after power-up, represented by start block 100, the machine 10 receives a payment value to be dispensed through the RS-232 communication link 91, as represented by process block 101. The main processor then causes energization of the motor 31 to move to the magazine 23 to the home position, as represented by process block 102. Then, as represented by decision block 103, instructions are executed to test whether the home position window 23*a* on the magazine 23 is aligned with the home position sensor 51. Once the home position is found, the channel counter register is reset as represented by process block 104. Then, instructions represented by a decision block 105 are executed to determine if payment is to be made from the first channel aligned with the ejector 80. If the answer is "YES," as represented by the "YES" result, the ejection solenoid 82 is actuated and the processor waits to detect the end of the channel sync signal from the sensor 45, as represented by process block 106. As an optional feature, the processor may also wait for a signal from the coin exit sensor 48 to confirm the ejection of the coin. A check is then made as represented by decision block 107 to see if this is the last channel from which coins need to be dispensed to reach the requested amount of change.

In the event that the result of executing decision block 105 or block 107 is "NO," then the main processor proceeds to execute program instructions represented by decision block 108 to test for low coins in one of the coin channels 24, but not necessarily the same channel as was checked for payment. This is because several coin channels 24 must pass the ejector 80 (FIG. 1) before they reach the low coin sensor 51 at the home position station 50. If the answer to the test in decision block 108 is "YES," as represented by the "YES" result, the main processor proceeds to execute an instruction to set a low coin bit for that channel 24 as represented by process block 109. The channel count is then incremented for each of the channel payment and low coin tests as represented by process block 110. The processor proceeds then to check the next channel 24 for payment or ejection of a coin. After all channels have been tested for payment, as represented by the "YES" result from decision block 107, the processor tests for completion of payment, as represented by decision block 111, keeping in mind that one revolution of the magazine may not result in all of the requested payment being dispensed. If payment is not complete, the main processor returns to the home position to begin another payment revolution of the magazine assembly 23. If payment is complete as represented by the "YES" result from decision block 111, the motor 31 is de-energized, and the routine is completed as represented by process block 112 and end block 113.

Figure 13:
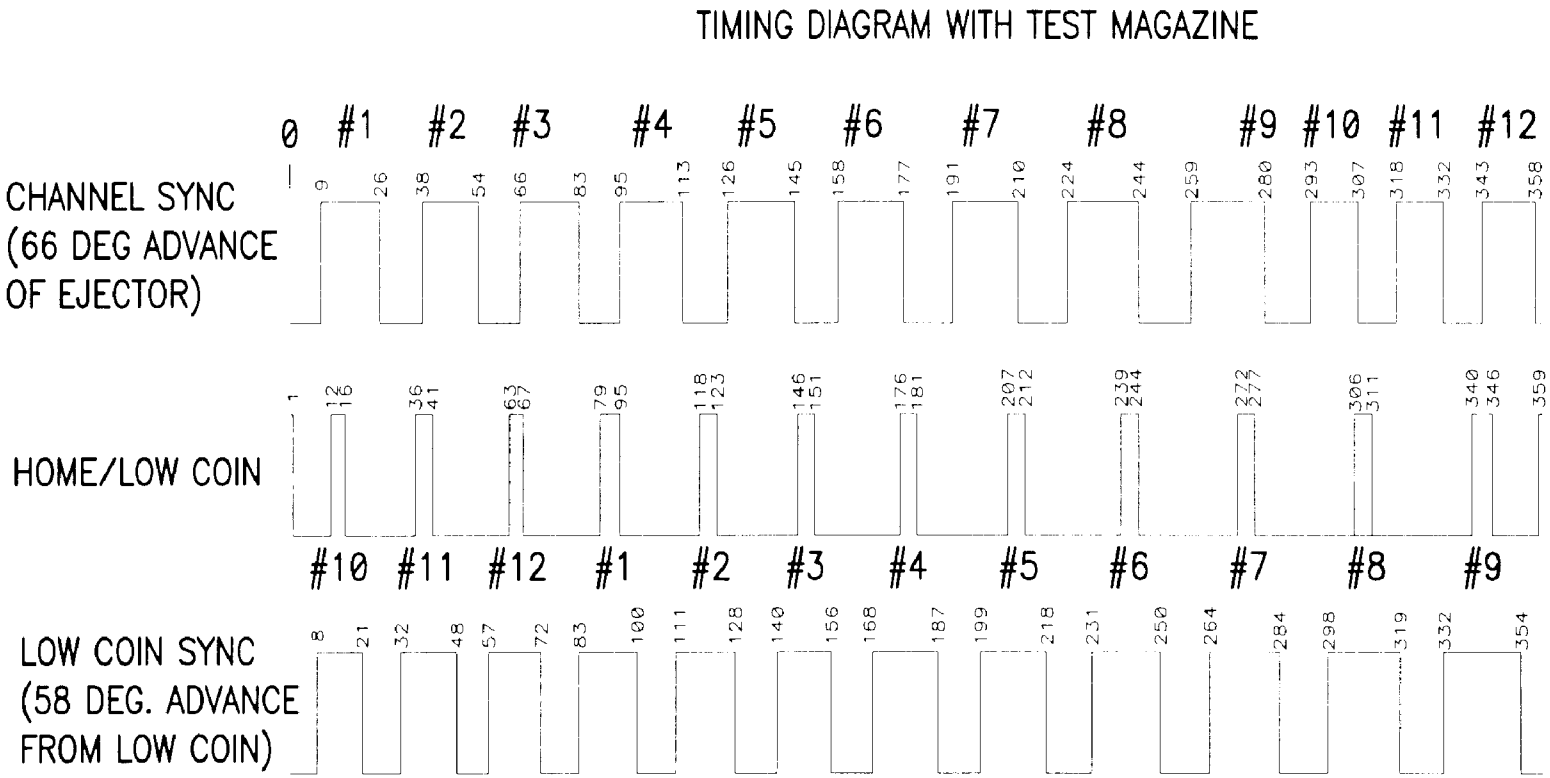
FIG. 13 is a timing diagram illustrating the operation of the embodiment of FIG. 1 with a test magazine.

FIG. 13 shows a timing diagram for all coin channels 24 for a test magazine in an embodiment in which the low coin sensor 46 is placed fifty-eight degrees in advance of the home/low coin sensor 51*a*, 51*b* and ejector sensor 45 is positioned sixty-six degrees in advance of the ejector 80. The marker tabs 65 are separated by an angle of fifty-eight to sixty-six degrees from their respective channels. The top graph represents logic high and low signals from the channel "sync" (coin eject) position sensor 45. The middle graph represents logic high and low signals from the low coin sensor 51. The lower graph represents logic high and low signals from the "low coin" position sensor 46.

The timing diagram shows that the channel sync and home/low coin signals are at a "1" or logic high condition only from 359 degrees to 1 degree, and this defines the "home" position. When the home/low coin detector 51*b* receives a signal from the home/low coin emitter 51*a*, a logic high signal ("1") is generated; if the signal path is blocked, a logic low ("0") is detected. When either the channel sync sensor 45 or the low coin sync sensor detects a marker tab, a logic high ("1") is generated. The coin ejector pin 81 is lifted during the time when the channel sync position sensor detects a "1" for that channel 24.

In FIG. 13, a test magazine 23 with channels 24 for holding different types of coins including U.S., U.K. and German denominations was tested. The magazine 23 was empty, so low coin signals ("1") are shown for all channels. Also the numbers at the corners of the logic pulses are the degrees of rotation of the magazine assembly 22 between the rising edge and trailing edge of each logic high signal relative to the home position window 23*a* on the magazine assembly. The #-designated numbers are the channel numbers. It can further be seen that although channel #1 is tested first for payment, channel #10 is tested first for a low coin condition. It can also be seen that the degrees of rotation for dispensing from channel #1 are the difference between nine degrees and twenty-six degrees. During this angle of rotation, the ejector pin 81 rises into the slot 63 in channel #1 as seen in FIG. 12*a* and moves through the end of slot 63, beyond the position in FIG. 12*b*. While the ejector solenoid 82 is energized, the magazine drive motor 31 may have power interrupted or reduced, to reduce power requirements. The energy stored in the rotating magazine 23 will provide enough force to eject the coin. The over-running clutch in the drive gear 32 allows the magazine assembly 22 to free-wheel in the forward direction only. After the payment is complete the motor is stopped so as to position the magazine 23 in the pre-accelerate position.

The exit sensor 48 (FIGS. 2 and 9) provides feedback to the main processor 90 to verify that a coin to be ejected has actually been dispensed to the change cup 28 and has not jammed. If a jam occurs, an alternate channel may be selected to dispense the change or an equivalent value of coins. An error message can also be transmitted to the operator through the RS-232 communication link 91.

The mix of coins contained in the magazine 23 is such that one complete rotation can provide up to 99 cents (or $4.99) in change. According to one preferred embodiment, the magazine assembly 22 is rotated at 30 RPM. If the change is dispensed in one revolution, this occurs in a time period of two seconds. Where necessary, the magazine 23 can be rotated through a second revolution to complete the dispensing of the requested amount of change. The magazine does not need to stop in order to complete a dispense cycle. If coins from multiple channels 24 in more than once revolution must be ejected to complete the payment of change, the motor 31 can be driven until payment is made and then index to the pre-accelerate position once again.

The dispenser 20 can be used with a variety of different magazines 23 containing different mixes of coins. For example, one magazine 23 could have coin channels with different sizes (diameters) to hold a mix of coins (pennies, nickels, dimes, quarters, dollar coins), while another magazine 23 could have coin channels with equal sizes (e.g., all holding quarters or tokens, which would be useful at an arcade).

Preferably the low coin sensor 51 is located at an appropriate height such that it will no longer sense coins in a coin channel 24 when there are a small number (e.g., 3–6) of coins remaining in the channel 24. The dispenser 20 can then avoid selecting channels 24 having a low supply (for example, if one quarter channel is low, a different quarter channel is selected, or two dime channels and one nickel channel are selected). The dispenser 20 also preferably provides an audible or visual alarm indicating that the magazine 23 should be replaced. Since the magazine 23 moves the channels 24 past the low-coin detector 51, it is only necessary to provide a single low coin sensor. However, as an additional feature, it is also possible to provide a second low coin detector located approximately halfway up the height of the magazine 23 in order to provide a signal indicating that a receptacle is about half-empty. If the magazine 23 is made from an opaque material, the magazine 23 will include the slots 24*c* in the channels 24 so that the low coin detector 51*b* can sense the coins. However, if the magazine 23 is made from a transparent plastic material, for example, it is not necessary to include slots 24*c* in the channels 24.

Another advantage of the disclosed construction is that it is easily adaptable to different coin mixes (i.e., to different magazines 23 having different numbers and sizes of slots). One coin dispenser 20 could be used with different magazines 23, including magazines with coins from different countries, simply by programming the coin dispenser 20 with data indicating the different types of coin mixes (including data on the coin denomination and the number of coins dispensed with one actuation of the coin ejector 80—usually one or two coins at a time) contained in the different magazines.

This has been a description of preferred embodiments of the invention. Those of ordinary skill in the art will recognize that modifications might be made while still coming within the scope and spirit of the present invention.

For example, although optical sensors are disclosed for the preferred embodiment, sonic sensors or proximity sensors might be substituted without departing from the scope of the broadest aspects of the invention. As another example, while the coin path is preferably circular, looped coin paths of non-circular shape might also be used.

And while tabs are used as the markers for position sensing of the magazine assembly, other types of markers can be used. Therefore, for the scope of the invention, reference is made to the following claims.

We claim:

1. A coin dispenser comprising:

a base;

a coin magazine with a plurality of coin channels for receiving stacks of coins, said coin magazine being mounted for rotation on said base around an axis of rotation such that the coin channels move along a looped coin path;

a coin ejector that is located at a single coin ejection location and proximate to said looped coin path, said ejector being operable in a direction substantially parallel to the axis of rotation for the coin magazine to move into and out of a selected coin channel to contact and eject a coin;

a position monitor for monitoring angular movement of the coin magazine and the respective coin channels in relation to the coin ejector, wherein the position monitor is positioned in advance of the coin elector by an angular distance along the coin path to allow anticipation of the coin channel from which a coin is to be dispensed; and an electronic control responsive to position signals from the position monitor for coordinating operation of the coin ejector to coincide with arrival of a selected coin channel at the coin ejection location.

2. The coin dispenser of claim 1, in which the looped coin path is circular.

3. The coin dispenser of claim 1, further comprising:

an exit for coins ejected as a result of operation of the coin ejector, said exit being disposed laterally outside of the looped coin path and extending laterally away from said coin magazine to a coin cup; and a coin exit sensor for signaling the electronic control to confirm the dispensing of an ejected coin.

4. The coin dispenser of claim 1, wherein the position monitor is positioned along the coin path in advance of the coin ejector by an angular distance of approximately eighteen degrees along the coin path to allow anticipation of the coin channel from which a coin is to be dispensed.

5. The coin dispenser of claim 1, wherein the position monitor further comprises markers mounted for movement with the coin magazine, said markers being located in positions corresponding to respective coin channels and an optical sensor associated with the coin ejector for detecting a marker corresponding to a selected coin channel from which a coin is to be dispensed.

6. The coin dispenser of claim 5, wherein the markers are located beneath the coin magazine and the optical sensor is located on the base of the coin dispenser.

7. The coin dispenser of claim 5, wherein the markers are tabs formed below the coin magazine and the optical encoder further comprises a light emitter and a light detector positioned on opposite sides of a groove in the base of the coin dispenser.

8. A coin dispenser comprising:

a base;

a coin magazine with a plurality of coin channels for receiving stacks of coins, said coin magazine being mounted for rotation on said base such that the coin channels move along a looped coin path;

a coin ejector that is located at a single coin ejection location and proximate to said looped coin path, said ejector being operable to extend into and out of a selected coin channel to contact and eject a coin;

a position monitor for monitoring angular movement of the coin magazine and the respective coin channels in relation to the coin ejector;

an electronic control responsive to position signals from the position monitor for coordinating operation of the coin ejector to coincide with arrival of a selected coin channel at the coin ejection location; and further comprising a low coin sensor and a second position monitor f or tracking angular movement of the coin magazine relative to the low coin sensor.

9. The coin dispenser of claim 8, wherein the second position monitor for tracking angular movement of the coin magazine relative to the low coin sensor further comprises: markers mounted for movement with the coin magazine, and a second optical sensor for detecting a marker corresponding to a selected coin channel in relation to the low coin sensor.

10. The coin dispenser of claim 9, wherein the second optical sensor is positioned in advance of the low coin sensor by an angular distance along the coin path to allow anticipation of the coin channel for which the low coin condition is to be checked.

11. The coin dispenser of claim 9, wherein the second optical sensor is positioned along the coin path in advance of the low coin sensor by an angular distance of approximately ten degrees along the coin path to allow anticipation of the coin channel for which the low coin condition it to be checked.

12. The coin dispenser of claim 8, wherein the coin magazine includes a home position portion which allows passage of signals from a low coin signal emitter to signal when the coin magazine home position portion is aligned with the low coin sensor.

13. The coin dispenser of claim 8, wherein each of the coin channels in the coin magazine is formed with a portion having a height above a bottom of the coin magazine that designates a low coin level in the respective coin channel; and wherein said portion allows passage of signals from a low coin signal emitter when each respective channel having a low coin condition is positioned opposite the low coin sensor.

14. A coin dispenser comprising:

a coin magazine with a plurality of coin channels for said base such that said coin channels move along a looped coin path;

a low coin sensor disposed at a low coin detection location along the coin path to detect an absence of coins in a selected coin channel at a predetermined height above a bottom support in the selected coin channel;

a position monitor for monitoring angular movement of the coin magazine and the respective coin channels in relation to the low coin detection location; and an electronic control responsive to signals from the position monitor for coordinating operation of the low coin sensor to coincide with arrival of the selected coin channel at the low coin detection location.

15. The coin dispenser of claim 14, wherein the position monitor for monitoring angular movement of the coin magazine relative to the low coin detection location further comprises: markers on the coin magazine, and an optical sensor for detecting a marker corresponding to a selected coin channel in relation to the low coin detection location.

16. The coin dispenser of claim 15, wherein the optical sensor is positioned in advance of the low coin detection location by an angular distance along the coin path to allow anticipation of the coin channel for which the low coin condition is to be checked.

17. The coin dispenser of claim 15, wherein the optical sensor is positioned along the coin path in advance of the low coin detection location by an angular distance between forty-five degrees and ninety degrees along the coin path to allow anticipation of the coin channel for which the low coin condition is to be checked.

18. The coin dispenser of claim 14, wherein the coin magazine includes a home position portion which allows passage of signals from the low coin signal emitter to signal when the coin magazine home position portion is aligned with the low coin detector.

19. A coin magazine assembly for a coin dispenser, said coin magazine assembly comprising:

an annular, integrally formed magazine base having a driven portion formed around a central opening by which mechanical power is imparted to the coin magazine assembly; and an annular, integrally formed coin magazine with a plurality of coin channels disposed in a circle for receiving stacks of coins, and wherein said magazine is mounted on said magazine base, and wherein said magazine base includes at least a portion of surfaces supporting the coins in the channels prior to ejection and wherein said magazine base forms portions of slots for receiving an ejector member for ejecting said coins from respective channels.

20. The coin magazine assembly of claim 19, wherein said surfaces supporting the coins in the channels further comprises partial floors integrally formed with the magazine and positioned in the respective channels for supporting the stacks of coins in the respective channels.

21. The coin magazine assembly of claim 20, wherein the coin magazine base also forms partial floors positioned beneath the respective channels to support coins as they are ejected from the respective channels.

22. The coin magazine assembly of claim 19, wherein said channels open in a direction that is disposed along an axis that is at an acute angle in relation to a radius of said coin magazine.

23. The coin magazine assembly of claim 19, wherein said coin magazine is formed with channels having a taper of not greater than 0.2 degrees, having a plurality of circumferentially spaced, zero taper ribs running up inner sidewall surfaces of the channels for securely holding the coins, with said ribs terminating a spaced distance from a top opening of the channels to allow for easier loading of coins.

24. The coin magazine assembly of claim 23, wherein said coin magazine is formed with angled portions leading into said channels from a top end to allow easier reception of coins.

25. The coin magazine assembly of claim 19, wherein the channels form slots on outer surfaces and further comprising L-shaped detents having an upright leg that fits in a respective slot, said detents also having a foot that projects into an exit from a coin channel to assist in holding the stack of coins in the channel.

26. The coin magazine assembly of claim 19, further comprising at least one coin detent which is positioned in an exit slot from a bottom of a respective coin channel to retain the lowermost coin from exiting the respective coin channel prior to coin ejection.

27. A coin dispenser comprising:

a base;

a coin magazine with a plurality of coin channels for receiving stacks of coins, said coin magazine being mounted for rotation on said base and being drivable through a ring gear;

a motor disposed in said base and inside of said ring gear when the magazine is installed; and a gear drive coupling said motor to drive said ring gear to drive said coin magazine.

28. The coin dispenser of claim 27, wherein said gear drive has at least one gear which is biased by a spring and yieldable in position for allowing easier meshing with said ring gear when said coin magazine is installed on said base.

29. The coin dispenser of claim 27, wherein said motor has a motor output shaft, and wherein said gear drive has as least one gear that is mounted to a motor output shaft through a single-direction-of-rotation roller clutch to limit free rotation of the magazine to one rotational direction.

30. The coin dispenser of claim 27, wherein said motor has a motor output shaft, and wherein said gear drive has at least one gear that is mounted to a motor output shaft through a torque-responsive slip ring which allows slippage of the gear drive in relation to the motor shaft in response to a predetermined torque being applied in a direction opposite a forward direction of rotation of the motor output shaft.

* * * * *

UNITED STATES PATENT AND TRADEMARK OFFICE

CERTIFICATE OF CORRECTION

PATENT NO. : 6,685,551 B2
DATED : February 3, 2004
INVENTOR(S) : Adams et al.

It is certified that error appears in the above-identified patent and that said Letters Patent is hereby corrected as shown below:

Column 10,
Line 64, "elector" should be -- ejector --.

Column 12,
After line 18, -- a base; -- should be inserted on a separate line.
Line 19, "for said" should read -- for receiving stacks of coins, said coin magazine being mounted for rotation on said --.

Signed and Sealed this

Fifteenth Day of February, 2005

JON W. DUDAS
*Director of the United States Patent and Trademark Office*